US010927554B1

(12) United States Patent
Kimble

(10) Patent No.: US 10,927,554 B1
(45) Date of Patent: Feb. 23, 2021

(54) MODULAR DETECTABLE WARNING SURFACE TILE, FRAME, AND ASSEMBLY

(71) Applicant: Donald L. Kimble, Duvall, WA (US)

(72) Inventor: Donald L. Kimble, Duvall, WA (US)

( * ) Notice: Subject to any disclaimer, the term of this patent is extended or adjusted under 35 U.S.C. 154(b) by 0 days.

(21) Appl. No.: 16/920,378

(22) Filed: Jul. 2, 2020

Related U.S. Application Data

(60) Provisional application No. 62/872,907, filed on Jul. 11, 2019.

(51) Int. Cl.
*E04F 15/02* (2006.01)
*E04F 13/08* (2006.01)

(52) U.S. Cl.
CPC .... *E04F 15/02044* (2013.01); *E04F 13/0862* (2013.01); *E04F 15/02005* (2013.01); *E04F 2015/02122* (2013.01)

(58) Field of Classification Search
CPC ..... E04F 15/02044; E04F 15/02005; E04F 13/0862; E04F 15/02452; E04F 15/02458
See application file for complete search history.

(56) References Cited

U.S. PATENT DOCUMENTS 4,744,194 A * 5/1988 Yasuyoshi ..... E04F 15/02458 52/126.6
5,271,690 A 12/1993 Fennessy
5,840,396 A 11/1998 Betz
5,927,030 A * 7/1999 Petit ..... H02G 3/285 52/220.1
6,718,714 B1 * 4/2004 Montgomery, Sr. ..... F24D 13/022 52/392
6,951,435 B1 10/2005 Fennessy
7,360,343 B1 * 4/2008 Spransy ..... E04F 15/02452 52/263

(Continued)

FOREIGN PATENT DOCUMENTS

CN 104168799 B 10/2017
FR 2716912 A1 * 9/1995 ..... E04H 3/28

(Continued)

OTHER PUBLICATIONS

"Access Tile Tactile Systems," Retrieved from <<https://web.archive.org/web/20180210201015/http://www.accesstile.com/>>, Feb. 10, 2018, 3 pages.

(Continued)

*Primary Examiner* — Adriana Figueroa
(74) *Attorney, Agent, or Firm* — Davin Chin; Chin IP, PLLC

(57) ABSTRACT

The disclosed technology is generally directed to a tile-and-frame assembly installable in concrete that includes a modular frame and a top panel. The frame includes four corner supports and side supports. Each corner support includes: a side wall, a second side wall, a brace, and an anchor. Each side support includes: a side wall, a brace, and an anchor. At least four side supports are situated along a perimeter of the frame such that the four corner supports and the side supports situated along the perimeter of the frame define the perimeter of the frame, and such that the frame size is modular based on a cardinality of the side supports situated along the frame perimeter. The top panel is coupled to the frame. The top panel includes at least one tactile feature.

20 Claims, 8 Drawing Sheets

(56) References Cited

U.S. PATENT DOCUMENTS

| | | | | |
|---|---|---|---|---|
| 7,674,066 | B2 | 3/2010 | Wehmeyer | |
| 7,735,278 | B2 | 6/2010 | Becker et al. | |
| 7,779,581 | B2 | 8/2010 | Flaherty et al. | |
| 7,891,927 | B2 | 2/2011 | Burger et al. | |
| D634,860 | S | 3/2011 | Kimble | |
| 7,955,024 | B2 | 6/2011 | Driscoll et al. | |
| 8,261,497 | B2 * | 9/2012 | Sippola | E01C 5/16 52/177 |
| 8,544,222 | B2 | 10/2013 | Sippola | |
| 8,662,788 | B2 | 3/2014 | Sippola | |
| 9,027,290 | B2 | 5/2015 | Sippola | |
| 9,297,169 | B2 * | 3/2016 | Pantev | E04F 13/0894 |
| 9,365,984 | B2 | 6/2016 | Flaherty et al. | |
| 9,408,772 | B2 | 8/2016 | Bub | |
| 9,447,548 | B2 | 9/2016 | Penland | |
| 9,663,902 | B2 | 5/2017 | Penland et al. | |
| 9,770,383 | B1 | 9/2017 | Meyers | |
| 10,184,216 | B2 | 1/2019 | Urbanek et al. | |
| 10,435,886 | B2 * | 10/2019 | Lafontaine Berger | E04F 15/02183 |
| D869,693 | S | 12/2019 | Meyers | |
| 10,557,460 | B2 * | 2/2020 | Webster | A43B 3/0015 |
| 2004/0042850 | A1 | 3/2004 | Provenzano | |
| 2005/0265782 | A1 | 12/2005 | Everett | |
| 2006/0227009 | A1 | 10/2006 | Koehn | |
| 2007/0086859 | A1 | 4/2007 | Julnes | |
| 2007/0175132 | A1 * | 8/2007 | Spransy | F24F 13/06 52/263 |
| 2008/0271662 | A1 | 11/2008 | Driscoll et al. | |
| 2010/0129150 | A1 | 5/2010 | Sippola | |
| 2010/0229783 | A1 | 9/2010 | Szekely | |
| 2010/0281789 | A1 * | 11/2010 | Vac | E04F 15/02458 52/126.5 |
| 2011/0185961 | A1 | 8/2011 | Flaherty et al. | |
| 2013/0212046 | A1 | 8/2013 | Henshue et al. | |
| 2015/0173995 | A1 | 6/2015 | Bub | |
| 2017/0096784 | A1 | 4/2017 | Szekely et al. | |

FOREIGN PATENT DOCUMENTS

| | | | | |
|---|---|---|---|---|
| FR | 2840337 | A1 * | 12/2003 | E04F 15/02458 |
| FR | 2900698 | A1 | 11/2007 | |

OTHER PUBLICATIONS

"ADA Compliant Mats," Retrieved from <<https://web.archive.org/web/20161229061156/http://www.calpaclab.com/ada-compliant-mats/>>, Date Dec. 29, 2016, 2 pages.

"Armor-Tile—Setting the Standards for Durability and Detectability in Tactile Warning Systems," Retrieved from <<https://web.archive.org/web/20180201121207/http://armor-tile.com/>>, Feb. 1, 2018, 11 pages.

"Cast-In-Place Tactile Panels," Retrieved from <<https://web.archive.org/web/20190317012345/https://adatile.com/cast-in-place-tactile-surface/>>, Mar. 17, 2019, 4 pages.

"Detectable Warning Systems," Retrieved from <<https://detectable-warning.com/>>, Retrieved date Jul. 20, 2020, 8 pages.

"Sidewalk Blocks 2x3," Retrieved from <<https://eco-flex.com/product/sidewalk-blocks-2x3/>>, Retrieved date Jan. 20, 2020, 3 pages.

"Tuftile—ADA Detectable Warning Products," Retrieved from <<https://web.archive.org/web/20190622040450/http://tuftile.com/>>, Jun. 22, 2019, 4 pages.

* cited by examiner

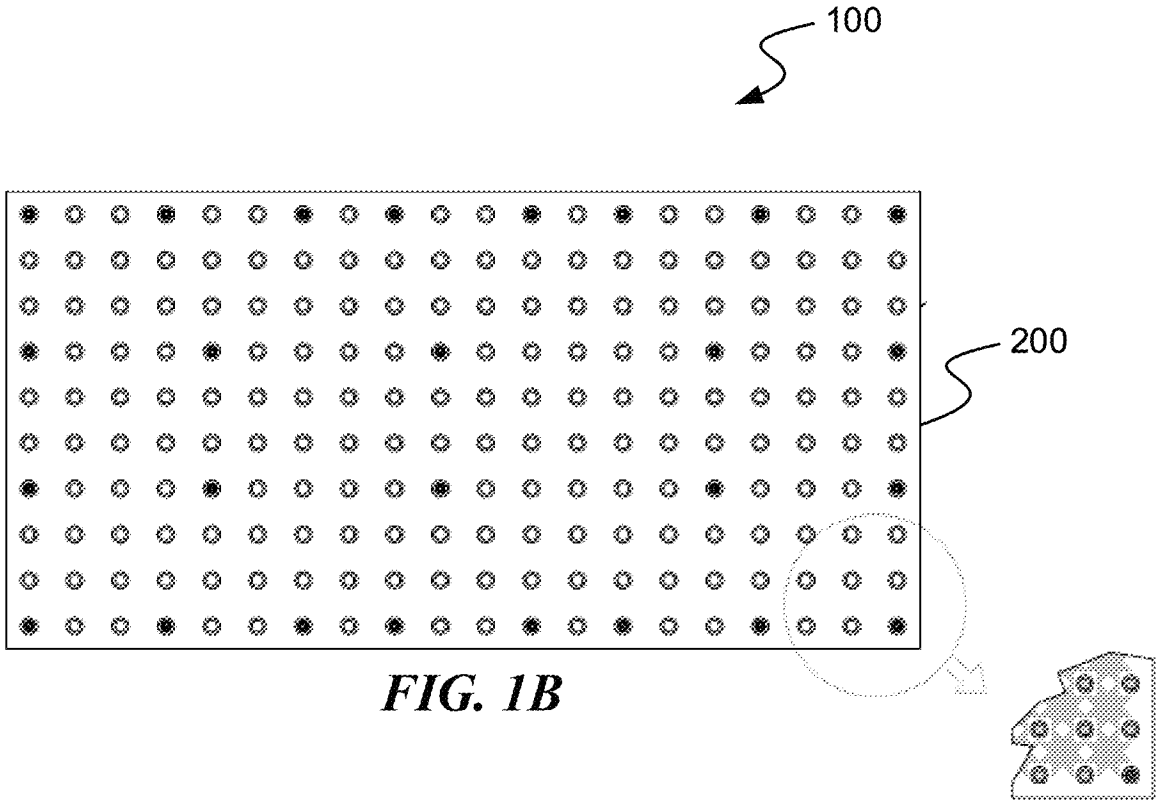
FIG. 1A
FIG. 1B
FIG. 1C
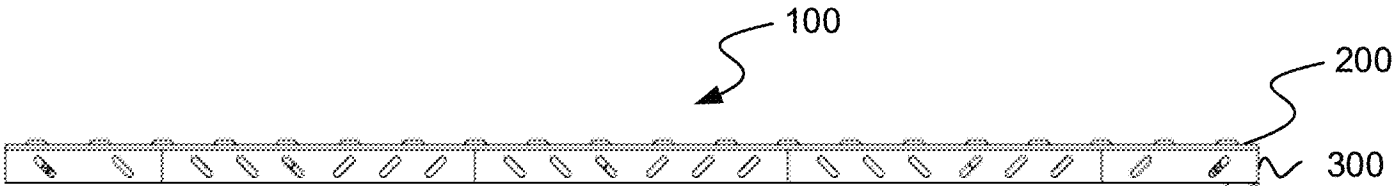
FIG. 1D

MODULAR DETECTABLE WARNING SURFACE TILE, FRAME, AND ASSEMBLY

CROSS-REFERENCE TO RELATED APPLICATION(S)

This application claims priority to U.S. Provisional Pat. App. No. 62/872,907, filed Jul. 11, 2019, entitled "MODULAR ADA TILE SYSTEM AND METHOD OF ASSEMBLY". The entirety of this aforementioned application is incorporated herein by reference.

FIELD OF INVENTION

This invention relates to detectable warning tiles, such as, for example, the Americans with Disabilities Act ("ADA") detectable warning tiles and more specifically to an detectable warning tile system including a modular frame for example, with improved ease of use in installing and replacement of detectable warning tiles.

BACKGROUND

ADA tiles are typically made of plastic or metal, and have raised, truncated domes, designed to alert visually impaired pedestrians to safety hazards such as street crossings, as required and regulated by the ADA. When visually impaired pedestrians encounter the raised, truncated domes, they may be alerted to an upcoming intersection or other danger by tactile warning. Areas for use of ADA tiles may include hazardous vehicular areas (e.g., intersections, street corners, and uncurbed transitions between pedestrian and vehicular areas) and areas having sudden drop-offs (e.g., train platforms and loading docks).

BRIEF DESCRIPTION OF THE DRAWINGS

Non-limiting and non-exhaustive examples of the present disclosure are described with reference to the following drawings. In the drawings, like reference numerals refer to like parts throughout the various figures unless otherwise specified. These drawings are not necessarily drawn to scale.

For a better understanding of the present disclosure, reference will be made to the following Detailed Description, which is to be read in association with the accompanying drawings, in which:

FIG. 1A is a left-side elevational view of an example two-by-four tile-and-frame assembly including a detectable warning surface tile;

FIG. 1B is a top plan view of the example tile-and-frame assembly of FIG. 1A;

FIG. 1C is a top plan view of a portion of the example tile-and-frame assembly of FIG. 1A;

FIG. 1D is a front elevational view of the example tile-and-frame assembly of FIG. 1A;

DETAILED DESCRIPTION

Figure 2B:
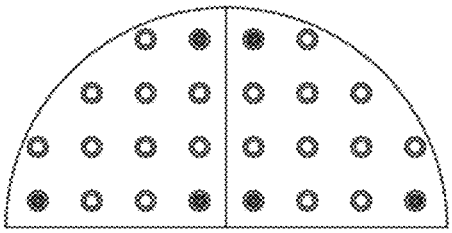
FIG. 2B is a top plan view of a portion of the example installation of FIG. 2A.

The following description provides specific details for a thorough understanding of, and enabling description for, various examples of the technology. One skilled in the art will understand that the technology may be practiced without many of these details. In some instances, well-known structures and functions have not been shown or described in detail to avoid unnecessarily obscuring the description of examples of the technology. It is intended that the terminology used in this disclosure be interpreted in its broadest reasonable manner, even though it is being used in conjunction with a detailed description of certain examples of the technology. Although certain terms may be emphasized below, any terminology intended to be interpreted in any restricted manner will be overtly and specifically defined as such in this Detailed Description section. Throughout the specification and claims, the following terms take at least the meanings explicitly associated herein, unless the context dictates otherwise. The meanings identified below do not necessarily limit the terms, but merely provide illustrative examples for the terms. For example, each of the terms "based on" and "based upon" is not exclusive, and is equivalent to the term "based, at least in part, on", and includes the option of being based on additional factors, some of which may not be described herein. As another example, the term "via" is not exclusive, and is equivalent to the term "via, at least in part", and includes the option of being via additional factors, some of which may not be described herein. The meaning of "in" includes "in" and "on." The phrase "in one embodiment," or "in one example," as used herein does not necessarily refer to the same embodiment or example, although it may. Use of particular textual numeric designators does not imply the existence of lesser-valued numerical designators. For example, reciting "a widget selected from the group consisting of a third foo and a fourth bar" would not itself imply that there are at least three foo, nor that there are at least four bar, elements. References in the singular are made merely for clarity of reading and include plural references unless plural references are specifically excluded. The term "or" is an inclusive "or" operator unless specifically indicated otherwise. For example, the phrases "A or B" means "A, B, or A and B." As used herein, the terms "component" and "system" are intended to encompass hardware, software, or various combinations of hardware and software. Thus, for example, a system or component maybe a process, a process executing on a computing device, the computing device, or a portion thereof. Throughout the specification and the claims, the meaning of the word "rectangle" includes "square," which is true of other forms of the word as well, so that the word "rectangular" is inclusive of the word "square," and so on.

Briefly stated, the disclosed technology is generally directed to a first tile-and-frame assembly installable in concrete. In one example of the technology, the first tile-and-frame assembly includes a modular frame and a top panel. In some examples, the modular frame includes four corner supports and a plurality of side supports. In some examples, each corner support of the four corner supports includes: a first side wall, a second side wall, a brace that is physically coupled to the first side wall and the second side wall, and an anchor. In some examples, the plurality of side supports includes at least four side supports.

In some examples, each side support of the plurality of side supports includes: a side wall, a first brace that is physically coupled to the side wall, and a first anchor. In some examples, at least four side supports of the plurality of side supports are situated along a perimeter of the frame such that the four corner supports and the at least four side supports situated along the perimeter of the frame define the perimeter of the frame, and such that a size of the modular frame is modular based on a cardinality of the at least four side supports situated along the perimeter of the frame. In some examples, the top panel is physically coupled to the four corner supports and the plurality of side supports. In some examples, the top panel includes at least one tactile feature. The at least one tactile feature may include raised, truncated domes; wayfinding bars; grooves; and/or other tactile features suitable for providing information to people who are visually impaired.

A modular tile-and-frame assembly installable in concrete may be used to provide a detectable warning surface that complies with applicable rules and regulations dealing with accessibility on walkways in public rights of way, to alert visually impaired individuals to potential hazards, such as curb drop-offs, street crossings, borders of pools, boating areas and marinas, oncoming traffic, railroad crossings, drop-offs from raised platforms and the like. For example, in the United States, a detectable warning surface may be used to comply with prevailing ADA rules and regulations, and those of state and local municipalities. This is not limited to the United States, as many jurisdictions outside of the United States may have similar laws regarding detectable warning surfaces for alerting visually impaired individuals to potential hazards.

In some examples, the top panel of the tile-and-frame assembly is a removable tile. The entire tile-and-frame assembly may be installed in wet concrete, or the top panel may be removed to install on hardened concrete. The tile-and-frame assembly may be replaceable without destroying the concrete, for example, in the event of damage to the tile, by removing and replacing the top panel. In some examples, the tile is replaceable without destroying the concrete even though the tile-and-frame assembly had been installed in wet concrete in one piece with perimeter flanges against which the tile-and-frame assembly could be finished with finishing tools.

In some examples, the tile-and-frame assembly maybe modular in multiple respects. As discussed above, in some examples, the tile-and-frame assembly maybe modular in terms of having a top panel that may be removed from the frame. In some examples, the frame itself maybe modular in multiple ways, including having a modular size. The frame may be composed of corner supports, such as one corner support for each of four corners of the frame, and further composed of sides supports. The size of the frame may be adjusted by adjusting the number (i.e., the cardinality) of side supports used in the perimeter of the frame. In some examples, multiple tiles maybe installed next to each other in concrete to provide a total detectable warning surface installation at a location. For instance, in some examples, two two-foot-by-four-foot tiles maybe installed adjacent to each other in concrete to provide a two-foot-by-eight-foot detectable warning surface installation in the concrete.

The corner supports and side supports used to compose the modular frame may each include diagonal slots. These diagonal slots may assist in getting air out when the tile-and-frame assembly in concrete, so as to substantially reduce the presence of air pockets in the concrete after the concrete hardens. The diagonal slots may also act as additional securing means, because the concrete will flow through the diagonal slots and harden after the tile-and-frame assembly has been installed. In some examples, slots other than diagonal slots may be used, such as round slots or slots of other suitable shapes.

Illustrative Tile-and-Frame Assembly

Example tiles may be used as detectable warning surfaces which comply with prevailing laws dealing with accessibility on walkways in public rights of way. For instance, example tiles may be used as detectable warning surfaces which comply with prevailing ADA rules and regulations, and those of state and local municipalities, dealing with accessibility on walkways in public rights of way. The detectable warning surfaces may be used to alert visually impaired individuals to potential hazards, such as curb drop-offs, street crossings, borders of pools, boating areas and marinas, oncoming traffic, railroad crossings, drop-offs from raised platforms, and/or the like.

As shown in FIGS. 1-8, examples of a modular tile-and-frame assembly 100 can include top panel 200 and a modular frame 300. In some examples, top panel 200 is a detectable warning surface tile such as an ADA tile. In some examples, top panel 200 is rectangular in shape. In some examples, top panel 200 maybe a shape other than rectangular, such as triangular, trapezoidal, pentagonal, hexagonal, wedge-shaped, octagonal, and/or other suitable shapes, and to fit in a juxtaposed manner to form a continuous surface in a pedestrian-use area, whether on a substantially flat surface or a partially sloping surface such as a wheelchair ramp. As but one example of juxtaposed shapes, in some examples, alternating rectangular tiles and wedge-shaped tile maybe arranged in a radial manner to provide a radius. Modular tile-and-frame assembly 100 is modular in size, and is accordingly shown in more than one size. For example, FIGS. 4A-4C show a modular tile-and-frame assembly 100, which is larger in size that that of FIG. 1B due to the modularity of the size of modular tile-and-frame assembly 100, as discussed in greater detail below.

In some examples, modular frame 300 has a perimeter that corresponds to the shape of the top panel. Modular frame 300 may include side supports 304 and corner supports 306. In some examples, each side support 304 and corner support 306 may include, among other things, an anchor 500. In some examples, each side support 304 is an arching truss that includes an anchor 500. In some examples, each corner support 306 includes two substantially perpendicular sides (where the sides may be straight, curved, and/or the like) forming a truss, where each corner support 306 includes an anchor 500. In some examples, anchors 500 couple modular frame 300 to concrete after tile-and-frame assembly 100 has been installed in wet concrete after the wet concrete has hardened.

In some examples, modular frame 300 is composed solely of side supports 304 and corner supports 306. In some examples, modular frame 300 is composed of side supports 304, corner supports 306, and other components, such as intermediate coupling components such as side walls or connecting pieces.

In some examples, modular tile-and-frame assembly 100 includes one tile. In some examples, modular tile-and-frame assembly 100 may include multiple tiles forming one tile perimeter.

Modular frame 300 maybe coupled to top panel 200 in various suitable ways in various examples. In some examples, top panel 200 is removable attached to modular frame 300. For instance, in some example, physically coupled to modular frame 300 via a plurality of fasteners, such as screws (e.g., screw 814). In some examples, top panel 200 is removably attached to anchors 500, such as via fasteners that are capable being removed, such as screws (e.g., screw 814). In some examples, each anchor 500 is physically coupled to top panel 300 via a corresponding fastener. In some examples, for each anchor 500 in modular frame 300, there is a corresponding fastener in a dome on top panel 300 that physically couples top panel 200 to anchor 500. In some examples, top panel 200 is removable from modular frame 300. In some examples, top panel 200 includes raised truncated domes and/or other suitable tactile features that are arranged such that top panel 200 includes at least one detectable warning tile. For example, top panel 200 may include a detectable warning surface that includes tactile features such as raised, truncated domes; wayfinding bars; grooves; and/or other suitable tactile surfaces that may provide information to people who are visually impaired. For instance, in some examples, top panel 200 may include a tile with wayfinding bars to direct visually impaired pedestrians in a particular direction. In some examples, top panel 200 may include a tile with grooves to direct visually impaired pedestrians in a particular direction. In some examples, top panel 200 may include a tile with raised, truncated bars to provide visually impaired pedestrians warning of a particular hazard, crossing, approach, and/or the like.

In various examples, the components of the modular tile-and-frame assembly 100 can be physically and/or logically integrated in any suitable manner (e.g., with any suitable distributions of functionality across the components, etc.), where examples of the modular tile-and-frame assembly 100 can include any suitable combination of components described herein, associated (e.g., mechanically couplable; functionally related; etc.) in any suitable manner. In some examples, different variations of side supports 304, corner supports 306, and optionally other components such as side walls can be used to frame multiple ADA tiles in one modular tile-and-frame assembly 100. If any portion of top panel 200 becomes broken, it maybe easily removed and replaced by removing the tile from the anchor(s) 500, the side support(s) 304, and from the corner support(s) 306 (e.g., by releasing one or more fasteners, such as by unscrewing one or more screws, that fasten the tile to the modular tile-and-frame assembly 100) in order to release one or more detectable warning surface tiles on top panel 200 to be replaced. In some examples, different variations of side supports 304 and corner supports 306 and optionally other components can be used to frame an detectable warning surface tile having a unique shape.

In some examples, the modular tile-and-frame assembly 100 has a removable top panel 200 even though modular tile-and-frame assembly 100 can be cast-in-place in wet concrete and has a perimeter flange of a suitable length for finishing against modular tile-and-frame assembly 100 when modular tile-and-frame assembly 100 is cast in place in wet concrete. For instance, in some examples, rather than having no perimeter flange, or having a perimeter flange that is only one-half inch or only three-quarter of an inch, the perimeter flange may instead be of suitable length into to the concrete such that modular tile-and-frame assembly 100 can be suitable finished with finishing tools after being cast in place into wet concrete, such as one and a half inches.

The perimeter flange may be provided by side walls of components forming the perimeter of the frame, such as the side walls of side supports 304 and the side walls of corner supports 306. In some examples, the side walls of optional intermediary connectors may also form a portion of the perimeter flange. In some examples, the perimeter flange is slotted with diagonal slots, including in the corners of the perimeter.

In some examples, these diagonal slots may act as vents to assist in getting air out when the tile-and-frame assembly in concrete, so as to substantially reduce the presence of air pockets in the concrete after the concrete hardens. Installation of a tile-and-frame assembly into fresh concrete may be difficult in that when the tile-and-frame assembly is installed into fresh concrete, it is desirable to get as much air out as possible in order to avoid air pockets. During installation, installers may attempt to force air out as much as possible. The diagonal slots may assist in substantially reducing air pockets. Also, as discussed above, the perimeter flange may assist in installation by allowing installers to finish around modular tile-and-frame assembly 100 with a finishing tool, which may help to cover up mistakes that have been made in the installation. The diagonal slots may also act as additional securing means to secure modular tile-and-frame assembly 100 to the concrete, because the concrete will flow through the diagonal slots and harden after the modular tile-and-frame assembly 100 has been installed.

In various examples, components of the modular tile-and-frame assembly 100 can be positioned at (e.g., mounted at, integrated with, located proximal, etc.) any suitable location (e.g., of other suitable components). In various examples, individual components and/or combination of components of the modular tile-and-frame assembly 100 can be characterized by any suitable lengths, widths, heights, depths, radiuses, circumferences, and/or any suitable dimensions, which can correspond to any suitable areas, volumes, and/or other suitable multi-dimensional characteristics required to frame one or more ADA tiles.

In various examples, components of the modular tile-and-frame assembly 100 can be manufactured using any one or more of: molding (e.g., injection molding, compression molding, overmolding etc.), etching, bonding, polishing, patterning, deposition, treatments, drilling, plating, routing, computer numerical control (CNC) machining & casting, stereolithography (SLA), Digital Light Synthesis (DLS), PolyJet additive manufacturing technologies, Fused Deposition Modeling (FDM), suitable prototyping approaches, and/or any other suitable manufacturing techniques. In various examples, components of the system can be constructed with any suitable materials, including elastomers, plastics (e.g., thermoplastics such as polypropylene, etc.), composite materials (e.g., thermoplastic elastomers, etc.), metals (e.g., steel, alloys, copper, etc.), recyclable materials, reusable materials, biodegradable materials, compostable materials, ceramic, and/or any other suitable materials. However, the modular tile-and-frame assembly 100 can be configured in any suitable manner.

In some examples, the components of the modular tile-and-frame assembly 100 can be manufactured, assembled and constructed off-site before distribution to installers, freeing up valuable time for installers on-site, and allowing the installers to quickly place the detectable warning surface tiles (such as ADA tiles) on-site by setting into wet concrete. In some examples, the modular tile-and-frame assembly 100 can be set into wet concrete in one piece, a process similar and no more time consuming than the process used in the background art by installers to set a typical ADA tile which cannot be easily removed.

Detectable warning surface tiles such as ADA tiles may break and/or wear over time. ADA tiles may fatigue, crack or warp under loading such as from fork-lifts or other vehicles, and the raised domes may be sheared off by vehicles such as snowplows. In the background art, replacement of ADA titles is typically difficult for ADA tile installers, because the large plastic ADA tiles are typically either set into concrete, or the tiles are placed onto pre-existing concrete with an adhesive during installation. In the background art, ADA tiles cannot typically be replaced without destroying the concrete structure around the tiles, leading to time consuming and costly repairs by ADA tile installers.

However, in some examples, use of the modular tile-and-frame assembly 100 can also save installers valuable time on-site when one or more detectable warning surface tiles (such as ADA tiles), crack or wrap and need replacement. In some examples, rather than needing to destroy the concrete structure around the tile, as is typically needed for an ordinary ADA tile placement, the tile is released from the modular tile-and-frame assembly 100 to quickly release the ADA tile(s) needing replacement (e.g., by unscrewing one or more screws that couple the tile to the modular tile-and-frame assembly 100), even though modular tile-and-frame assembly 100 has a perimeter flange of suitable depth for finishing around the perimeter fringe with finishing tools.

As discussed above, modular tile-and-frame assembly 100 is composed of only side supports 304 and corner support 306 in some examples. In other examples, other components may also be included in modular tile-and-frame assembly 100, such as one or more of the following components: one or more splice anchor supports 708, one or more side walls, and/or the like. For instance, in some examples, modular tile-and-frame assembly 100 can alternatively also include one or more side walls. In some of these examples, the one or more side walls include a flange for coupling to a side support 304 or corner support 306. The optional side walls maybe straight and/or curved. The optional one or more side walls are maybe couplable (e.g., physically attachable to, physically mountable on, fittable around, etc.) to a supporting member (e.g., an extending portion of the supporting member), such as facilitated by the side wall-coupling mechanism, and/or by a supporting member-coupling mechanism. Additionally or alternatively, one or more side walls can be physically couplable and/or integrated with any suitable components of the modular tile-and-frame assembly 100. However, the side wall may be couplable and/or otherwise related to any other suitable components. The side wall may include any suitable dimensions, such as in relation to length, width, height, and/or diameter.

In some examples that include optional connecting side walls, in some examples, each side wall may include a female connector on each end, each side support 304 may have a male connector on each end, and each corner support 306 may have a male connector on each end. Many other alternative arrangements are also possible. For instance, instead, each side wall may have a male connector on each end, each side support 304 may have a female connector on each end, and each corner support 306 may have a female connector on each end. In some arrangements, the side walls serve as intermediary connection pieces by which the corner supports and side supports may connect along the perimeter of modular frame 300.

In some examples in which frame 300 includes side supports 304 and corner supports 306 and does not include intermediary connecting pieces, side supports 304 may each have a male connector on one end and a female connector on the other end, and corner supports 306 may each have a male connector on one end and a female connector on the other end. In this way, each side wall of each corner support 306 may connect with a side support 304.

The modular tile-and-frame assembly 100 may include one or more modular frames 300. The one or more modular frame 300 may function to place modular tile-and-frame assembly 100 into wet concrete, for placing modular frame 300 through the use of an adhesive, and allow one or more detectable warning surface tiles on top panel 200 to be removed without destroying concrete. Additionally or alternatively, modular frame 300 can function to allow top panel 200 to removably couple to a surface, which can facilitate the replacement of, substitution of, and/or other use of different detectable surface tiles on top panel 300.

In some examples, modular frame 300 has a perimeter that corresponds to a regulatory required ADA tile perimeter or other detectable warning surface complying with laws, rules, and/or the like in a particular jurisdiction. In some examples, modular frame 300 has a rectangular shape, and top panel 200 has a corresponding rectangular shape. In some examples, the rectangular shape is a square shape.

Figure 3:
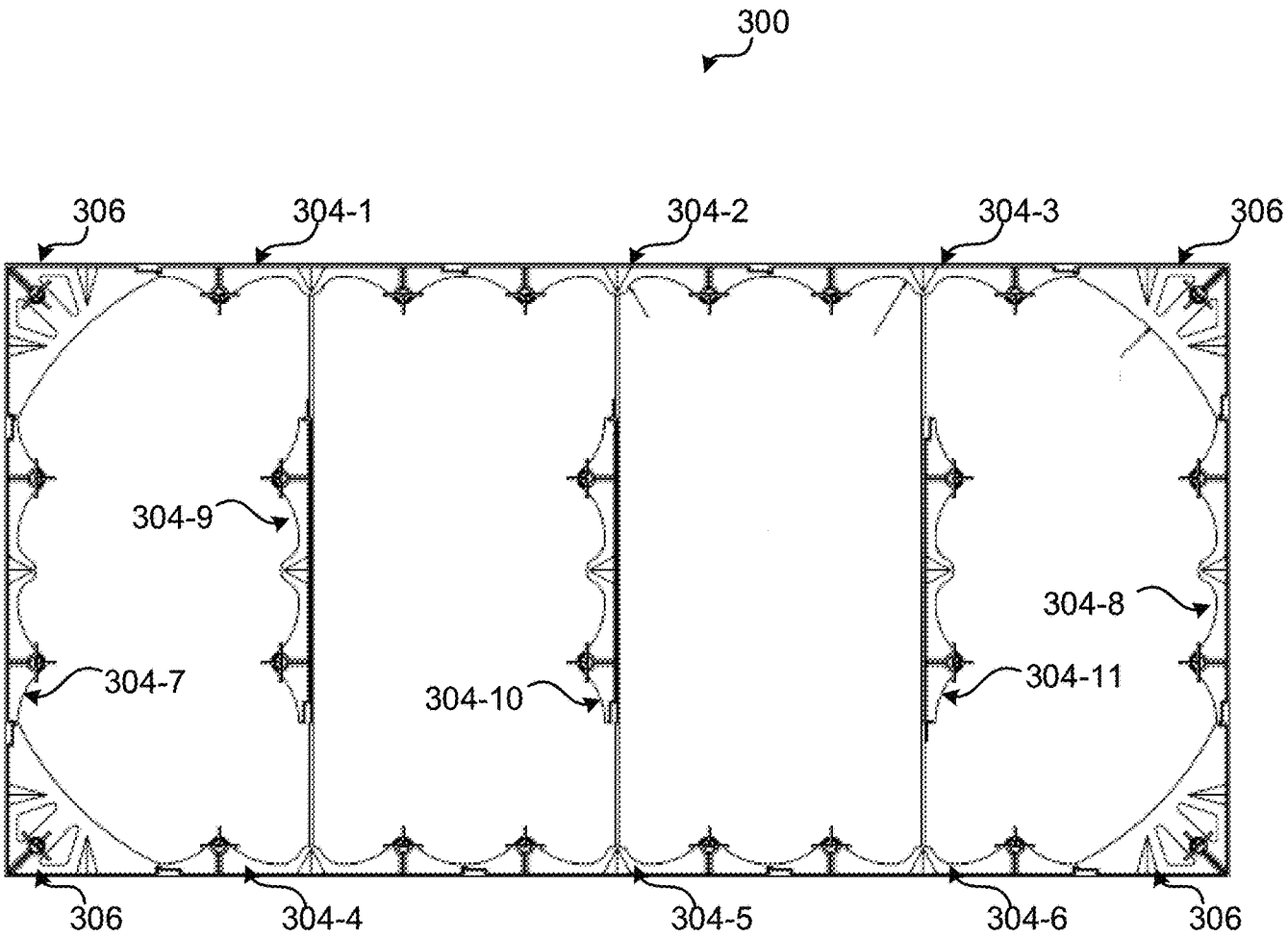
FIG. 3 is a bottom plan view of the example tile-and-frame assembly of FIG. 1A.

In some examples, side supports 304 are used only along the perimeter of modular frame 300. In some examples, some side supports 304 are used along the perimeter of frame 300, and other side supports 304 are used on the interior. For examples, FIG. 3 illustrates a two-foot-by-four-foot tile-and-frame assembly that includes 11 side supports 304-1 through 304-11, where eight side supports 304-1 through 304-8, in conjunction with the four corner supports 306, are situated along the perimeter of modular frame 300 and define the perimeter of modular frame 300. FIG. 3 further illustrates modular frame 300 including three side support 304-9 through 304-11 used within the interior of modular frame 300 in some examples.

In some examples, top panel 200 may have one or more grooves at the bottom of top panel 200. In some examples, there is a groove at the bottom of top panel 200 along the perimeter of top panel 200. In some examples, on the top of top panel 200, there is not only a groove along the perimeter of top panel 200, but only grooves throughout the center of the tile. In some examples, for surface-applied hardened concrete installations, application adhesive maybe placed in the groove for adhering top panel 200 to the hardened concrete. In some examples, in fresh concrete installations, the groove(s) provide an interface into which the side supports 304 and corner support 306 are placed. For instance, in some examples, the bottom of top panel 200 may have a groove molded around the perimeter of top panel 200, into which corner supports 306 and side supports 304-1 through 304-8 are placed, and grooves through the center of the tile which may provide an interface into which interior side supports 304-9 through 304-11 maybe placed.

Figure 7C:
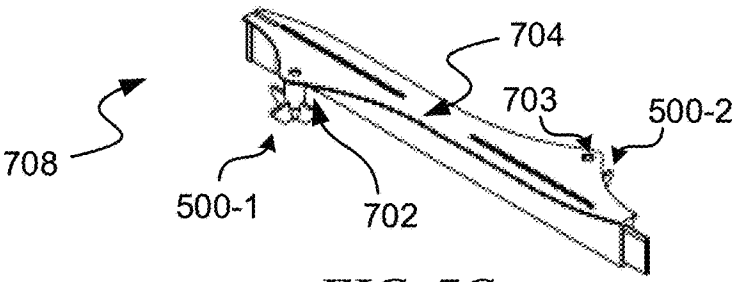
FIG. 7C is a top perspective view of an example splice anchor support.
Figure 7D:
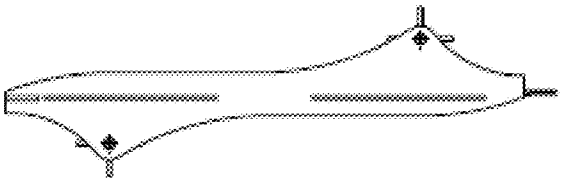
FIG. 7D is a top plan view of the example splice anchor support of FIG. 7C.
Figure 7E:
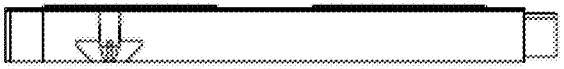
FIG. 7E is a front elevation view of the example splice anchor support of FIG. 7C.
Figure 7F:
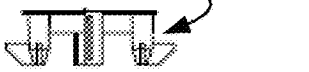
FIG. 7F is a side elevation view of the example splice anchor support of FIG. 7C.
Figure 7G:
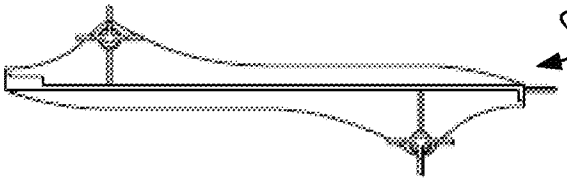
FIG. 7G is a bottom plan view of the example splice anchor support of FIG. 7C.
Figure 7A:
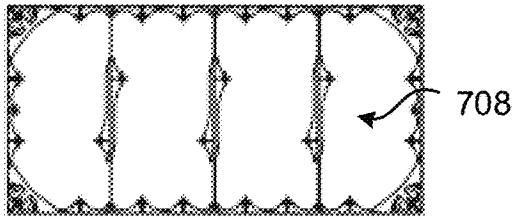
FIG. 7A is a bottom plan view of an example two-by-four tile-and-frame assembly that includes splice anchor supports.
Figure 7B:
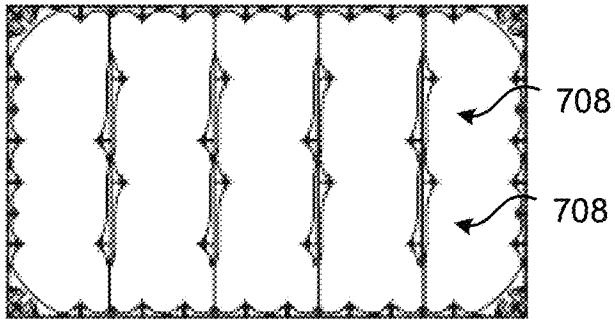
FIG. 7B is a bottom plan view of an example three-by-five tile-and-frame assembly that includes splice anchor supports.

In some examples, rather than using side supports 304 in the interior of the frame 300, splice anchor support 708 maybe used in the interior of the frame 300, as illustrated in FIG. 7A and FIG. 7B. The use of splice anchor supports 708 rather than side supports 304 in the interior of the frame 300 may facilitate the use of multiple tiles in the frame 300 in some examples.

In some examples, modular frame 300 has a modular size based on the number side supports 304 used along the perimeter of the frame. For instance, FIGS. 1A-1D and FIG. 3 illustrate an example two-foot-by-four-foot tile-and-frame assembly that includes eight side support 304-1 through 304-8 along the perimeter of modular frame 300. In some examples, a rectangular tile-and-frame that is smaller or larger in either or both dimensions may be formed by adding or removing side supports 304 in the corresponding dimensions relative to the example illustrated.

For instance, a two-foot-by-three-foot tile-and-frame assembly instance be constructed by using six side supports along the perimeter, omitting side supports 304-2 and 304-5 (this would also result in removal of side support 304-10).

Figure 4A:
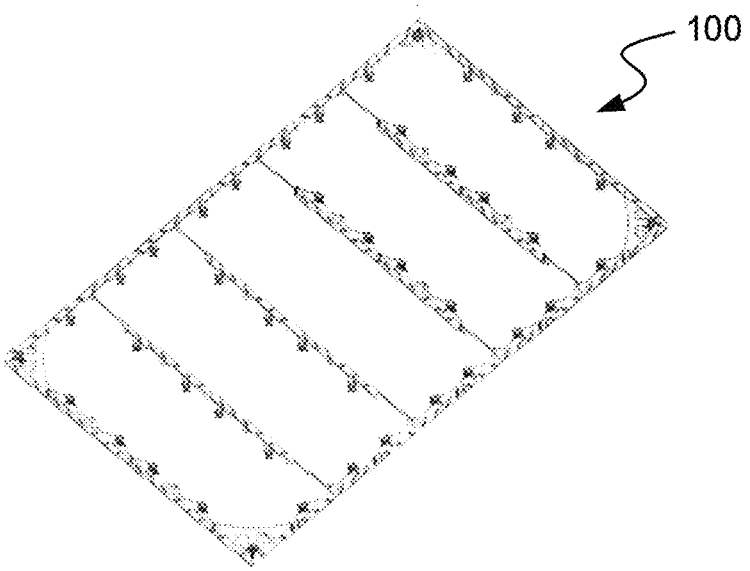
FIG. 4A is a bottom perspective view of an example three-by-five tile-and-frame assembly.
Figure 4B:
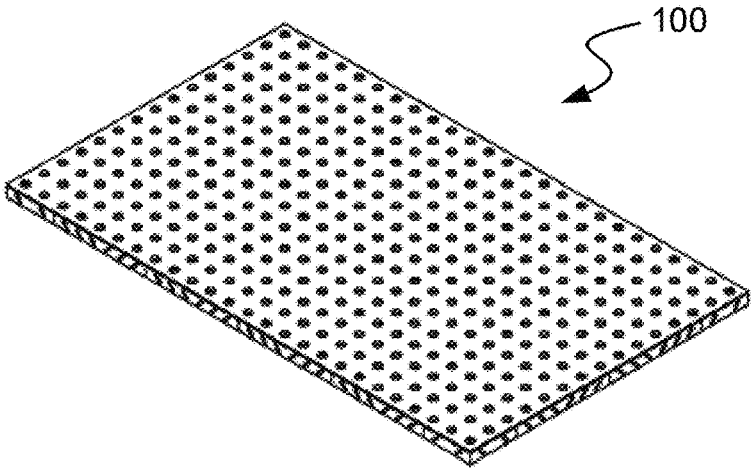
FIG. 4B is a top perspective view of the example tile-and-frame assembly of FIG. 4A.
Figure 4C:
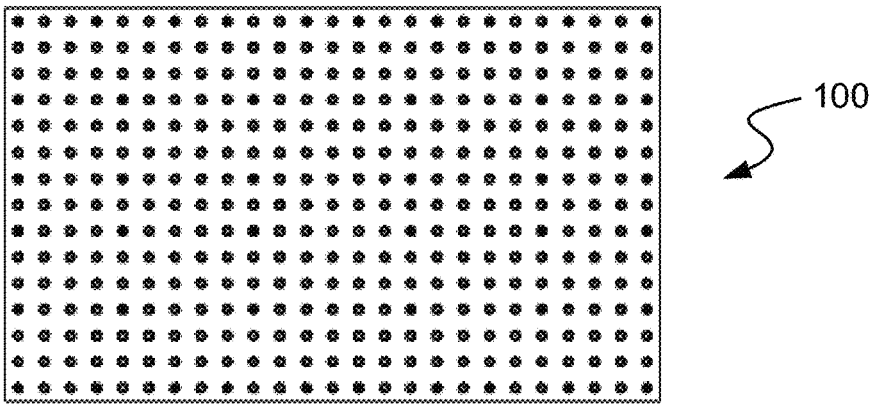
FIG. 4C is a top plan view of the example tile-and-frame assembly of FIG. 4A.
Figure 5A:
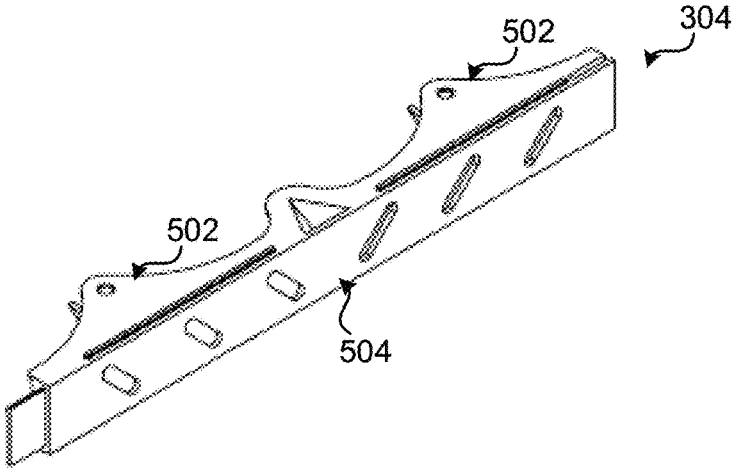
FIG. 5A is a perspective view of an example side support.
Figure 5B:
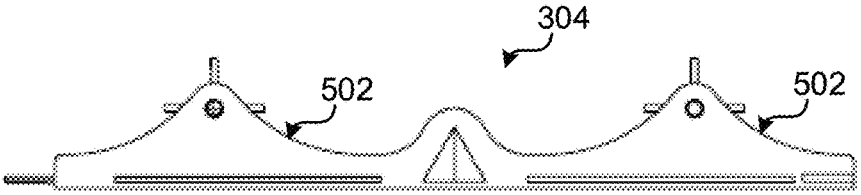
FIG. 5B is a top plan view of the example side support of FIG. 5A.
Figure 5C:
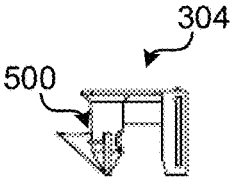
FIG. 5C is a side elevation view the example side support of FIG. 5A.
Figure 5D:
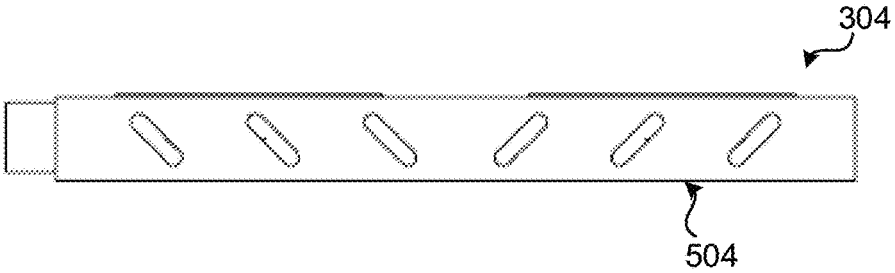
FIG. 5D is a front elevation view of the example side support of FIG. 5A.
Figure 5E:
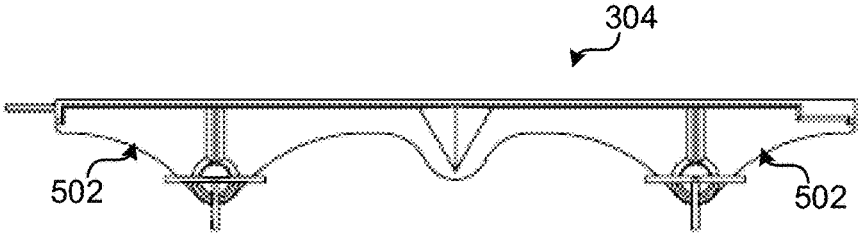
FIG. 5E is a bottom plan view of the example side support of FIG. 5A.
Figure 6A:
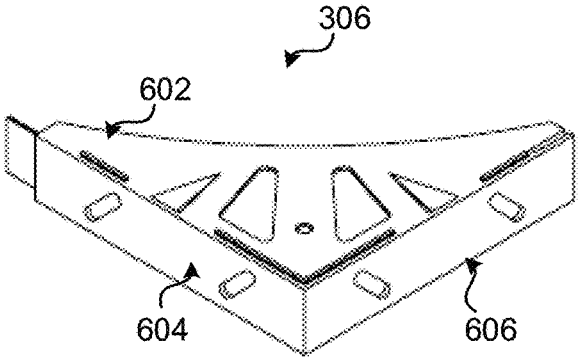
FIG. 6A is a perspective view of an example corner support.
Figure 6B:
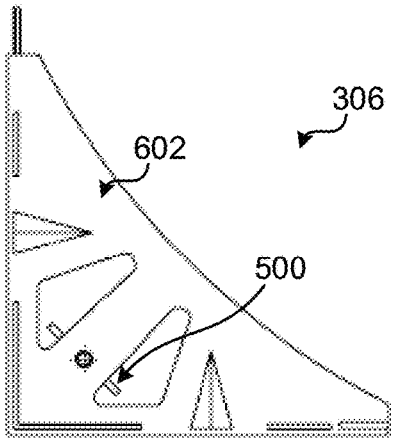
FIG. 6B is a top plan view of the example corner support of FIG. 6A.
Figure 6C:
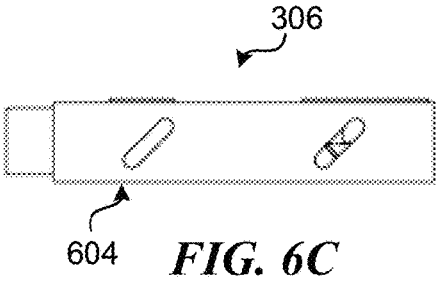
FIG. 6C is a side elevation view the example corner support of FIG. 6A.
Figure 6D:
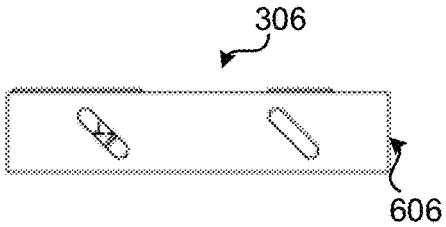
FIG. 6D is a front elevation view of the example corner support of FIG. 6A.
Figure 6E:
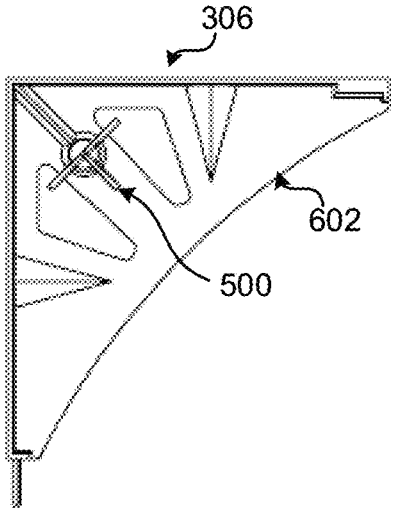
FIG. 6E is a bottom plan view of the example corner support of FIG. 6A.

As another example, as shown in FIGS. 4A-4C, a three-foot-by-five-foot tile-and-frame assembly could be constructed using ten six side supports along the perimeter, adding one side support to each of the four side of modular frame 300 relative to the two-foot-by-four-foot tile-and-frame assembly shown in FIG. 1 and FIG. 3. As shown in FIGS. 4A-4C, the three-by-five-foot tile-and-frame assembly may also include one additional side support 304 in the interior portion of the modular frame.

The particular number (i.e., cardinality) of side supports 304 that maybe used to provide a frame of a particular size may vary in different examples. For instance, in various examples, the size of the side supports may vary. For instance, although the side supports 304 shown each have two braces and two anchors, in other examples, the side supports 304 may be half of this size and each include only one brace and one anchor. Also, in some examples, intermediate connecting pieces may be used, which may affect the number of side supports 304 used to provide a particular size of frame in some examples.

In maybe desirable to use different frame sizes in different circumstances depending on a variety of circumstances. In some examples, the needs and circumstances of a particular installation may vary depending on the type and size of hazard for which the installation is used to provide a warning to visually impaired people. Also, the rules, regulations, laws, and/or the like may vary by jurisdiction, thus mandating that a different size of tile be used. For example, many jurisdictions may require that a detectable warning surface be twenty-four inches in the direction of travel. However, the state of California may require that a detectable warning surface be thirty-six inches in the direction of travel. Accordingly, a different size of detectable warning surface tile maybe used in California than in other areas.

In some examples, multiple tile and-frame assemblies may be installed next to each other in concrete to provide a total detectable warning surface installation at a location. For instance, in some examples, alternating rectangular-shaped tiles and wedge-shaped tiles are arranged in a curved manner to provide a radius. Accordingly, such rectangular-shaped and wedge-shaped tiles maybe installed in a particular installation to provide a radius.

Figure 2A:
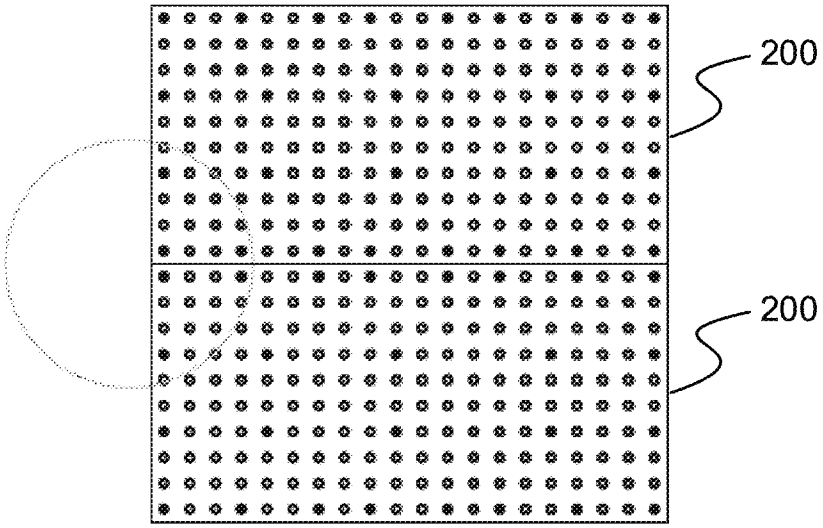
FIG. 2A is a top plan view of an example four-by-four installation that includes two adjacent two-by-four tile-and-frame assemblies.

In some examples, two two-foot-by-four-foot tile-and-frame assemblies may be installed adjacent to each other in concrete to provide a two-foot-by-eight-foot detectable warning installation in the concrete. As another example, two two-foot-by-four-foot tile assemblies maybe installed adjacent to each other in concrete to provide a four-foot-by-four-foot detectable warning installation in the concrete, as illustrated in FIGS. 2A-2B.

In some examples, a top panel 200 may include exactly one tile. In some examples, a top panel 200 may include multiple tiles in one frame 300. In some examples, the use of multiple tiles in one frame 300 may be facilitated by using splice anchor supports 708, as illustrated in FIG. 7A and FIG. 7B.

Illustrative ADA Tile

The modular tile-and-frame assembly 100 may include one or more ADA tiles on a top panel 200. An example two-foot-by-four-foot top panel 200 can be seen in FIG. 1. In some examples, the ADA tiles function as a tactile surface and may take the form of a tile or panel. The ADA title may take the form of a variety of shapes, such as triangular, trapezoidal, pentagonal, hexagonal, or octagonal. The tiles or panels may be fabricated from any suitable material, or different portions may be made from a variety of materials, including, but not limited to, steel, stainless steel, galvanized steel, hard plastics, impact resistant plastics and composites, fiber reinforced plastics, resins, and/or the like.

In some examples, the ADA tiles may be created using a modular mold. The mold may be the largest size expected to be used for any panels, such as a three-foot-by-five-foot rectangular mold in some examples. In some examples, to create a tile that is smaller than a three-foot-by-five-foot rectangular tile in either or both dimensions, such as to create a two-foot-by-five-foot rectangular tile, a two-foot-by-four-foot rectangular tile, a three-foot-by-four-foot rectangular tile, or a three-foot-by-three foot rectangular tile, the unused portions of the mold may be blocked out, so that the mold is modular. In this way, in some examples, one mold may be used for all sizes of tiles to be created, rather than needing a separate mold for each size of tile to be created.

Illustrative Side Support

The modular tile-and-frame assembly 100 may include one or more side supports 304. FIGS. 5A-5E illustrate an example side support 304. The one or more side supports 304 may each include anchor 500, one or more braces 502 (with two braces shown in the example illustrated), and a slotted side wall 504. In some examples, one or more braces 502 are physically coupled to slotted side wall 504. In some examples, each anchor 500 of side support 304 is physically coupled to a corresponding brace 502 of side support 304. In some examples, anchor 500 is physically coupled to a different portion of side support 304, such as slotted side wall 504. In some examples, each brace 502 is a truss assembly. In some examples, side supports 304 do not include a brace, and are instead effectively braced by their attachment to top panel 200, or in some other suitable manner.

In some examples, slotted side wall 504 has a first end that is physically couplable to a side wall of a corner support and is also physically couplable to a side wall of another side support, and a second end that is physically couplable to a side wall of a corner support and that is also physically couplable to a side wall of another side support. For instance, in some examples, slotted side wall 504 has a male connector on one end and a female connector on the other end, and the corner supports are attached to other components with a female connector at the end of one side wall and a male connector at the end of another side wall. However, alternatively, in some examples, side support 304 may instead be connected to other components such as corner supports and other side supports via intermediary connecting pieces, and may instead have, for example, a female connector at each end, or a male connector at each end.

Figure 8:
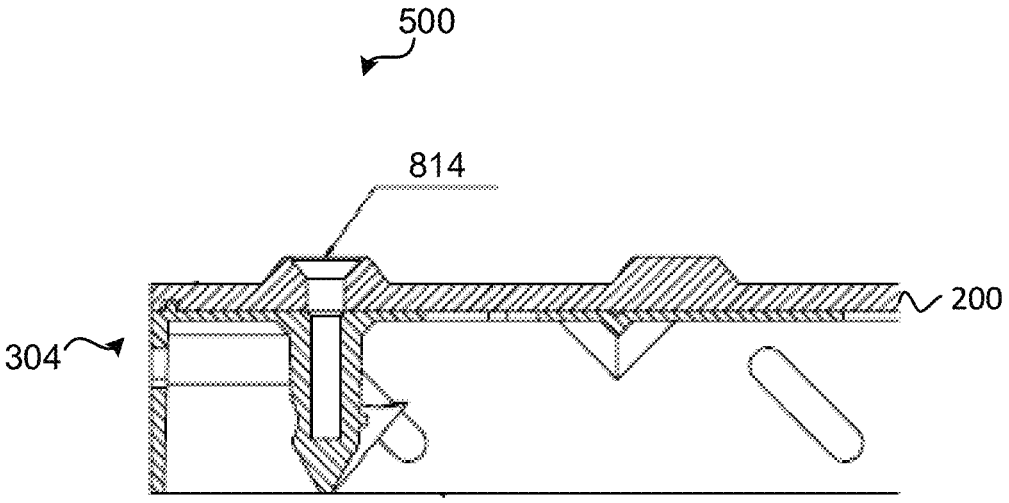
FIG. 8 is a cutaway side elevation view of a portion of the example tile-and-frame assembly of FIG. 1A, in accordance with aspects of the present invention.

In some examples, the slots on the slotted side wall 504 are diagonal slots. In various examples, the slotted side wall 504 may be straight and/or curved. In some examples, the one or more side supports 304 are physically couplable to other side supports 304 or to corner supports 306. In some examples, the one or more side supports 304 are physically couplable to optional intermediary connectors. As discussed above, each anchor 500 may serve a function of securing modular tile-and-frame assembly 100 in concrete, and each anchor 500 maybe attached to top panel 200 by a screw or other fastener, as shown in FIG. 8 according to one example. Additionally or alternatively, one or more side supports 304 can be physically couplable and/or integrated with any suitable components of the modular tile-and-frame assembly 100. However, in various examples, the side support 304 can be couplable and/or otherwise related to any other suitable components. In various examples, the side support 304 can include any suitable dimensions, such as in relation to length, width, height, and/or diameter.

Different types of anchors 500 maybe used in various examples. FIGS. 1-8 show a particular type of anchor 500. However, in other examples, other types of anchors suitable for acting as fastening points to fasten file-and-frame assembly 100 into concrete may be used. For instances, in some examples, anchors 500 may be threaded inserts or the like.

Illustrative Corner Support

The modular tile-and-frame assembly 100 may include one or more corner supports 306. FIGS. 6A-6E illustrate an example corner support 306. The one or more corner supports 306 may include anchor 500, brace 602, and first slotted side wall 604, and second slotted side wall 606. In some examples, second slotted side wall 606 is substantially perpendicular first slotted side wall 604, brace 602 is physically coupled to first slotted side wall 604 and second side wall 606. In some examples, anchor 500 is physically coupled to brace 602. In some examples, anchor 500 is coupled to a different portion of corner support 306, such as slotted side wall 604 and/or slotted side wall 606. In some examples, each brace 602 is a truss assembly. In some examples, corner supports 306 do not include a brace, and are instead effectively braced by their attachment to top panel 200, or in some other suitable manner.

In some examples, the slotted side walls 604 and 606 are physically couplable to side supports 304. In some examples, the slotted side walls 604 and 606 are physically couplable to intermediary connectors. Additionally or alternatively, one or more corner supports 306 can be physically couplable and/or integrated with any suitable components of the modular tile-and-frame assembly 100. However, in various examples, the corner support 306 can be couplable and/or otherwise related to any other suitable components. In various examples, the corner support 306 can include any suitable dimensions, such as in relation to length, width, height, and/or diameter.

As with side supports 304, in some examples, anchors 500 of corner supports 306 may serve a function of securing modular tile-and-frame assembly 100 in concrete, and each anchor 500 may be attached to top panel 200 by a screw or other fastener. Also as discussed with regard to side support 304, the anchors 500 of corner supports 306 may be any type of anchor suitable for acting as fastening points to fasten modular tile-and-frame assembly 100 into concrete and/or other suitable material.

Illustrative Splice Anchor Support

The modular tile-and-frame assembly 100 may include one or more splice anchor supports 708. FIGS. 7A and 7B illustrate examples of modular tile-and-frame assembly 100 that includes splice anchor supports 708. More specifically, FIG. 7A illustrates an example of modular tile-and-frame assembly 100 that is a two-by-four assembly that includes splice anchor supports 708, and FIG. 7B illustrates an example of modular tile-and-frame assembly 100 that is a three-by-five tile-and-frame assembly that includes splice anchor supports 708. FIGS. 7C-7G illustrate an example splice anchor support 708.

Splice anchor support 708 may include first anchor 500-1, second anchor 500-2, first brace 702, second brace 703, and side wall 704. In some examples, first anchor 500-1 is physically coupled to first brace 702, and second anchor 500-2 is physically coupled to second brace 703. In some examples, first anchor 500-1 and/or second anchor 500-2 is coupled to a different portion of splice anchor support 708, such as side wall 704. In some examples, each brace 702 and 703 is a truss assembly. In some examples, splice supports 708 do not include a brace, and are instead effectively braced by their attachment to top panel 200, or in some other suitable manner. In some examples, first anchor 500-1 disposed on a first side of splice anchor support 708 and second anchor 500-2 is disposed on the opposite side of splice anchor support 708 as first anchor 500-1, so that splice anchor support 708 is roughly symmetric about side wall 704 with first anchor 500-1 and second anchor 500-2 opposite the line of symmetry relative to each other, as illustrated in FIGS. 7A-7G.

In some examples, splice anchor supports 708 are physically couplable to other splice anchor supports 708. In some examples, side wall 704 of one splice anchor support 708 maybe directly physically coupled to a side wall 704 of another splice anchor support 708. In some examples, the side walls 704 of different splice anchor supports 708 maybe coupled to each other via intermediary connectors. Additionally or alternatively, one or more splice anchor supports 708 can be physically couplable and/or integrated with any suitable components of the modular tile-and-frame assembly 100. However, in various examples, splice anchor support 708 can be couplable and/or otherwise related to any other suitable components. In various examples, splice anchor support 708 can include any suitable dimensions, such as in relation to length, width, height, and/or diameter.

CONCLUSION

While the above Detailed Description describes certain examples of the technology, and describes the best mode contemplated, no matter how detailed the above appears in text, the technology can be practiced in many ways. Details may vary in implementation, while still being encompassed by the technology described herein. As noted above, particular terminology used when describing certain features or aspects of the technology should not be taken to imply that the terminology is being redefined herein to be restricted to any specific characteristics, features, or aspects with which that terminology is associated. In general, the terms used in the following claims should not be construed to limit the technology to the specific examples disclosed herein, unless the Detailed Description explicitly defines such terms. Accordingly, the actual scope of the technology encompasses not only the disclosed examples, but also all equivalent ways of practicing or implementing the technology.

I claim:

1. An apparatus, comprising:

a first tile-and-frame assembly, including:

a frame that is modular, including:

four corner supports, wherein each corner support of the four corner supports includes: a first side wall, a second side wall, a brace that is physically coupled to the first side wall and the second side wall, and a corner anchor;

a plurality of side supports including at least four side supports, wherein each side support of the plurality of side supports includes: a side wall, a first brace that is physically coupled to the side wall, and a side anchor, wherein at least four side supports of the plurality of side supports are situated along a perimeter of the frame such that the four corner supports and the at least four side supports situated along the perimeter of the frame define the perimeter of the frame, and such that a size of the frame is modular based on a cardinality of the at least four side supports situated along the perimeter of the frame; and a splice anchor support, the splice anchor support includes a first splice anchor disposed on a first side of the splice anchor support and a second splice anchor disposed on a second side of the splice anchor support, and wherein the second side of the splice anchor support is opposite the first side of the splice anchor support; and a top panel that is physically coupled to the four corner supports and the plurality of side supports, the top panel including at least one tactile feature.

2. The apparatus of claim 1, wherein the first side wall of at least one of the four corner supports has at least one diagonal slot.

3. The apparatus of claim 1, wherein, for at least one of the four corner supports, the first side wall has at least one diagonal slot, and the second side wall has at least one diagonal slot.

4. The apparatus of claim 1, wherein the side wall of at least one side support of at least one of the plurality of side supports has at least one diagonal slot.

5. The apparatus of claim 1, wherein anchors of the plurality of side supports and anchors of the four corners supports are physically coupled to the top panel via a plurality of fasteners, such that the top panel is removable from the frame by removing the plurality of fasteners.

6. The apparatus of claim 1, further comprising a second tile-and-frame assembly, wherein the first tile-and-frame assembly is installed in concrete, and wherein the second tile-and-frame assembly is installed adjacent to the first file-and-frame assembly in concrete.

7. The apparatus of claim 1, wherein each side support of the plurality of side supports further includes a second brace that is physically coupled to the side wall, and another anchor that is physically coupled to the second brace.

8. The apparatus of claim 1, wherein the frame is rectangular in shape, and wherein the top panel is rectangular in shape.

9. The apparatus of claim 1, wherein the top panel includes at least one Americans with Disabilities Act (ADA) tile.

10. The apparatus of claim 1, wherein for each of the four corner supports, the second side wall is substantially perpendicular to the first side wall.

11. The apparatus of claim 1, wherein the first tile-and-frame assembly is installable in concrete.

12. The apparatus of claim 1, wherein the top panel is removable from the frame.

13. The apparatus of claim 12, wherein the frame includes a perimeter fringe that extends at least one inch away from the top panel.

14. A method, comprising assembling a tile-and-frame assembly from components, the components comprising:

four corner supports, wherein each corner support of the four corner supports includes: a first side wall having at least one diagonal slot, a second side wall that is substantially perpendicular to the first side wall, a brace that is physically coupled to the first side wall and the second side wall, and a corner anchor that is physically coupled to the brace;

a plurality of side supports including at least four side supports, wherein each side support of the plurality of side supports includes: a side wall including a first end that is physically couplable to a side wall of a corner support and a second end that is physically couplable to a side wall of a corner support, a first brace physically coupled to the side wall, and a side anchor that is physically coupled to the first brace, wherein at least four side supports of the plurality of side supports are composable together with the four corner supports to form a perimeter of a frame of the tile-and-frame assembly such that a size of the frame is modular based on a cardinality of the at least four side supports situated along the perimeter of the frame;

a splice anchor support, the splice anchor support includes a first splice anchor disposed on a first side of the splice anchor support and a second splice anchor disposed on a second side of the splice anchor support, and wherein the second side of the splice anchor support is opposite the first side of the splice anchor support; and a detectable warning tile, the detectable warning tile being physically couplable to each anchor of the plurality of side supports and to each anchor of the four corner supports.

15. The method of claim 14, further comprising:

installing the time-and-frame assembly in concrete.

16. The method of claim 14, wherein the detectable warning tile is removable from the frame after the tile-and-frame assembly is installed in concrete, and wherein the side walls of each of the four corner supports and each of the plurality of side supports is at least one inch in height such that the at least four side supports of the plurality of side supports are composable together with the four corner supports to form the perimeter of the frame such that the perimeter of the frame has a perimeter flange that extends downward at least one inch.

17. An apparatus, comprising:

a rectangular modular frame, including:

four corner supports, wherein each corner support of the four corner supports includes: a first side wall, a second side wall that is substantially perpendicular to the first side wall, a brace that is physically coupled to the first side wall and the second side wall, and a corner anchor that is physically coupled to the brace;

a plurality of side supports including at least four side supports, wherein each side support of the plurality of side supports includes: a side wall, a first brace coupled to the side wall, and a side anchor that is physically coupled to the first brace, wherein at least four side supports of the plurality of side supports are situated along a perimeter of the frame such that the four corner supports and the at least four side supports situated along the perimeter of the frame define the perimeter of the frame; and a splice anchor support, the splice anchor support includes a first splice anchor disposed on a first side of the splice anchor support and a second splice anchor disposed on a second side of the splice anchor support, and wherein the second side of the splice anchor support is opposite the first side of the splice anchor support.

18. The apparatus of claim 17, wherein the first side wall of at least one of the four corner supports has at least one diagonal slot.

19. The apparatus of claim 17, wherein the rectangular modular frame is a square modular frame.

20. The apparatus of claim 17, further comprising:

a top panel that is physically coupled to the four corner supports and the plurality of side supports, the top panel including at least one tactile feature arranged such that the top panel includes a detectable warning surface tile, wherein the top panel is removable from the rectangular modular frame, and wherein the rectangular modular frame includes a perimeter fringe that extends at least one inch away from the top panel.

* * * * *